US008353994B2

(12) United States Patent
Schaedeli et al.

(10) Patent No.: US 8,353,994 B2
(45) Date of Patent: Jan. 15, 2013

(54) PROPULSION SYSTEM FOR THE ACCELERATION OF PROJECTILES

(75) Inventors: Ulrich Schaedeli, Plasselb (CH); Hanspeter Andres, Bern (CH); Kurt Ryf, Wimmis (CH); Dominik Antenen, Wattenwil (CH); Beat Vogelsanger, Thun (CH)

(73) Assignee: Nitrochemie Wimmis AG, Wimmis (CH)

( * ) Notice: Subject to any disclaimer, the term of this patent is extended or adjusted under 35 U.S.C. 154(b) by 1643 days.

(21) Appl. No.: 11/798,878

(22) Filed: May 17, 2007

(65) Prior Publication Data

US 2012/0138201 A1 Jun. 7, 2012

(30) Foreign Application Priority Data

May 19, 2006 (EP) ..... 06405217

(51) Int. Cl.

| | |
|---|---|
| ***D03D 23/00*** | (2006.01) |
| ***D03D 43/00*** | (2006.01) |
| ***C06B 31/00*** | (2006.01) |
| ***C06B 25/00*** | (2006.01) |

(52) U.S. Cl. ..... 149/45; 149/88; 149/109.2; 149/109.4

(58) Field of Classification Search ..... 149/88, 149/45, 109.2, 109.4

See application file for complete search history.

(56) References Cited

U.S. PATENT DOCUMENTS

| | | | | |
|---|---|---|---|---|
| 3,798,085 | A | 3/1974 | Mellow | |
| 4,092,188 | A | 5/1978 | Cohen et al. | |
| 4,923,536 | A | 5/1990 | Canterberry et al. | |
| 4,925,503 | A | 5/1990 | Canterberry et al. | |
| 5,218,166 | A | 6/1993 | Schumacher | |
| 5,468,312 | A | 11/1995 | Martin et al. | |
| 5,500,060 | A * | 3/1996 | Holt et al. | 149/19.1 |
| 5,682,009 | A | 10/1997 | O'Meara et al. | |
| 6,345,577 | B1 * | 2/2002 | Cramer et al. | 102/290 |
| 6,984,275 | B1 | 1/2006 | Walsh et al. | |
| 2002/0043316 | A1 * | 4/2002 | Ryf et al. | 149/14 |

FOREIGN PATENT DOCUMENTS

| | | |
|---|---|---|
| DE | 2260259 | 12/1972 |
| EP | 1031548 A1 | 8/2000 |
| EP | 1164116 A1 | 12/2001 |
| EP | 1616845 A1 | 1/2006 |
| GB | 2258230 A | 2/1993 |
| GB | 2326875 A | 1/1999 |

OTHER PUBLICATIONS

6001 Chemical Abstracts, 130*1999 ebruary 22, No. 8 Clolumbis, Ohio, US XP-000861165, p. 887.

* cited by examiner

*Primary Examiner* — James McDonough

(74) *Attorney, Agent, or Firm* — Birch, Stewart, Kolasch & Birch, LLP

(57) ABSTRACT

The propulsion system for the acceleration of projectiles is based on nitrocellulose and contains a crystalline energy carrier on a nitramine base and an inert plasticizing additive. The nitramine compound contains a structural element of the general chemical structure formula R—N—$NO_2$, where R is a residual.

The nitramine compound is present in a concentration in the range from 1 to 35% by weight, in particular in the range from 5 to 25% by weight. The nitramine compound is preferably RDX. The inert plasticizing additive is a water-insoluble polyoxo compound, if necessary in combination with a substance containing carboxyl groups. In layers near the surface an increased concentration can be present. The inert plasticizing additive is present in a concentration of 1 to 5% by weight.

16 Claims, 1 Drawing Sheet
(1 of 1 Drawing Sheet(s) Filed in Color)

PROPULSION SYSTEM FOR THE ACCELERATION OF PROJECTILES

FIELD OF THE INVENTION

The invention concerns a propulsion system for the acceleration of projectiles that is based on nitrocellulose, and also a method for the manufacture of a propulsion system.

BACKGROUND OF THE INVENTION

An important perception for ammunition manufacturers from warring conflicts in recent times consists in the fact that the weapons and ammunition platforms currently in use are only able to offer insufficient protection against enemy attacks. These new threat scenarios exist essentially in conditions of enemy fire on light and medium armoured vehicles, where the armour of the latter is relatively easily penetrated. The threat is also intensified by the fact that the weapons that provide the threat are easily transportable and are to be found in large numbers in uncontrolled circulation. There thus exists a definite need for improvement with regard to the ability to resist the detrimental mechanical agencies caused by bombardment of the ammunition with e.g. a hollow charge jet, hot metal fragments, or bullets. The vulnerability of ammunition is in fact a systems issue, but one in which the propellant charge powder exerts a strong influence.

Moreover the recent past has shown that the risk of conflicts in hot climate zones must be classified as clearly increasing. Such types of "out of area" actions in hot climate zones in general demand an improvement in the chemical stability of a propellant charge powder, such that its safety during handling, use and storage remains fully guaranteed. Further examples, where an improvement in chemical and thermal stability is required, occur in modern fighter aircraft in the form of extremely severe thermal cycling of the ammunition carried, with temperature peaks of more than 100° C. ("fast cook-off"), or in the ability of ammunition to resist fires ("slow cook-off"). The chemical stability of a propellant charge powder, which determines both its service life and also its "cook-off" temperature, thus represents a further area of activity with a need for improvement.

For several years, therefore, developments have been in progress with the objective of preparing propellant charge powders with a high performance potential and improved properties with regard to vulnerability (i.e. with regard to mechanical agencies) and "cook-off" (i.e. with regard to thermal agencies). Here there exists the challenge that a propellant charge powder to be used for military purposes must exhibit as high an energy density as possible, but at the same time should exhibit as low a vulnerability as possible with regard to mechanical and thermal agencies. This requirement is of outstanding importance for enclosed spaces such as for example occur in tanks, armoured troop carriers, or warships.

For quite some time an attempt has been made to fulfil this requirement by means of so-called "insensitive ammunition" (IM), for which purpose a new LOVA (low vulnerability ammunition) propellant charge powder has been developed. These propellant charge powders typically contain between 60 to 80% by weight of a crystalline explosives material, and about 10 to 25% by weight of an inert or energetic binder. Typical explosive materials in LOVA propellant charge powders are cyclotetramethylenetetranitramine (HMX) and cyclotrimethylenetrinitramine (RDX). Present LOVA propellant charge powders consist typically of a synthetic inert or energetic elastomeric polymer binder in which the crystals of the explosive in question are embedded. Typical binders are CAB and HTPB (inert) and GAP, poly-AMMO and poly-BAMO.

In the case of propellant charge powders (in short: TLPs) for weapons applications a distinction is made between "homogeneous" and "composite" (heterogeneous) formulations, where homogeneous formulations include monobasic and dibasic propellant charge powders. In extensive IM tests it has been found that a LOVA propellant charge powder based on an inert binder exhibits advantages compared with conventional powders with regard to thermal agencies (cook-off). In contrast it has been shown that compositions of this type can detonate in the event of mechanical agencies, a fact that has up to the present time hindered their wide-scale introduction and use (c.f. e.g. L. M. Barrington, Australian Defence Force (ADE), DSTO-TR-0097).

An example of a LOVA-TLP with an energetic synthetic binder is described in U.S. Pat. No. 6,228,190, where the binder consists of a nitratoalkyl-substituted alkyl ether-prepolymer with reactive hydroxy end groups and a cross-linking agent on the basis of a polyvalent isocyanate compound. From practice it is known art that powders constituted from such types of binders are brittle at lower temperatures and that their manufacture is very expensive and difficult.

LOVA-TLPs with an elastomeric binder containing polyurethane represent a further class of LOVA-TLPs of known art and are described in U.S. Pat. No. 4,925,503, U.S. Pat. No. 4,923,536 and U.S. Pat. No. 5,468,312 amongst other sources. The extended chain polyurethane polyacetal elastomer binder is obtained by means of a reaction of a dihydroxy-terminated polyacetal-homopolymer with an alkylene-diisocyanatc, subsequent conversion of the resulting isocyanate-terminated prepolymer with a dihydroxy-terminated polyacetal copolymer and a final reaction of this elastomeric intermediate stage with an organic polyisocyanate. Since the manufacture of this elastomeric binder system requires a number of synthesis steps the costs are very high. In addition it has been shown in the past that reproducibility presents great problems such that the LOVA-TLPs obtained cannot be manufactured with the required uniformity of product properties. For these reasons LOVA-TLPs on this basis have not been able to achieve acceptance on a broad front up to the present time.

A further class of LOVA-TLP uses cellulose acetate or derivatives of this (e.g. cellulose acetate butyrate, CAB) as the elastomeric binder. Compositions of this type are described in U.S. Pat. No. 6,984,275 amongst other sources.

The LOVA compositions of known art are unsatisfactory, since their reproducibility is insufficiently guaranteed and the manufacturing costs are relatively high. They have therefore not found practical application.

SUMMARY OF THE INVENTION

The object of the invention is to create a propulsion system belonging to the technical field cited in the introduction that has a low sensitivity to mechanical agencies, good "cools-off" properties and at the same time a high performance potential.

The solution of this object is defined by means of the features of claim 1. In accordance with the invention the propulsion system contains nitrocellulose as a base, as well as a crystalline energy carrier on a nitramine base. Moreover it contains one or a plurality of inert plasticising additives, wherein at least one of the inert plasticising additives is present in a matrix of the propulsion system, and the one and/or another inert plasticising additive has an increased concentration in zones near the surface.

What is surprising is that by the introduction of only relatively small amounts (e.g. <10% by weight) of inert plasticising additives the ability to resist mechanical stimuli can be significantly improved. Depending on the application, combinations of a plurality of, and in particular different, inert additives can also be introduced to adjust the desired thermodynamic properties such as power output or temperature characteristics. Moreover the inert plasticising additives are optimally distributed in the propulsion systems according to the invention. The increased concentration in the zones near the surface has the advantage that for the same total quantity of inert plasticising additives its quantity in the grain matrix can be reduced. Thus the proportion of energy rich substances in the propulsion system can be increased, without thereby impairing the resistance to mechanical stimuli. Particularly advantageously different inert plasticising additives are used in the grain matrix and in the zones near the surface. The grain structure of propulsion systems of this type is matched to the specific application (adjustment of the combustion characteristics to barrel length, projectile weight, etc. of the weapon system).

For improvement, i.e. optimisation, of the desired effects additional small amounts (usually less than 5% by weight) of energetic plasticisers, e.g. on the basis of metyl-VENA (CAS-No. 17096-47-0), ethyl-NENA (CAS-No. 85068-73-1) or butyl-NENA (CAS-No. 82486-82-6) can optionally be used.

Comparable monobasic propulsion systems that do not contain the novel combination of additives, do not exhibit any IM properties.

A further great advantage of the propulsion systems in accordance with the invention is the surprisingly high level of energy conversion, which leads to a high internal ballistic performance. Thus it has been found that the thermal efficiency i.e. the proportion of the TLP energy content converted into muzzle kinetic energy, is up to 44% in the case of full calibre ammunition. In the case of small calibre KE ammunition (KE=kinetic energy), i.e. in the case of ammunition with a sabot, thermal efficiencies of up to 36% have been found. This corresponds in comparison to conventional monobasic propellant charge powders to an increase of the energy conversion capability of up to 10% for a comparable performance level. This manifests itself in the previously mentioned increase in internal ballistic performance potential without any deterioration in barrel erosion, since the flame temperature in comparison to a normal monobasic TLP is for practical purposes not increased.

The propulsion systems in accordance with the invention are moreover distinguished by a temperature characteristic that is to a large extent neutral. This means that for practical purposes the same internal ballistic performance data are obtained independently of powder bed temperature over a wide temperature range, which for use in hot and cold climate zones is very much to be desired. Thus for example for a 30 mm full calibre ammunition for an airburst application it has been found that the muzzle velocity varies by only 12 m per second over a temperature range from −32° C. up to +52° C. The maximum muzzle velocity is typically obtained at around 21° C. and decreases continuously as temperatures either increase or decrease from this value. An analogous characteristic Is also found for the peak gas pressure. Conventional monobasic TLPs typically exhibit a linear rise in muzzle velocity of 0.5 to 1.0 in per second per degree centigrade, so that for monobasic TLP the muzzle velocity fluctuates over the same temperature range by 40 to 80 m per second.

In contrast to the LOVA compositions of previous known art cited earlier the propulsion system in accordance with the invention is not primarily based on the crystalline energy carrier. The proportion of nitrocellulose is much more predominant in the total weight (>50% by weight; in particular >60% by weight). The use of nitrocellulose ensues that the average distances between the individual crystals of the crystalline energy carrier are sufficiently large, in other words, that the individual crystals to a large extent do not make contact with each other. The result is that with the agency of external mechanical stimuli the shock pulse cannot be transferred from one crystal of the explosive material to the neighbouring lying crystals. This prevents the primary affecting shock pulse from multiplying and being transmitted across the whole quantity of powder.

A further difference between the invention and the LOVA compositions of previous known art exists in the fact that the hydrogen content in the combustion gases is not increased. In comparison to the LOVA compositions of previous known art with crystalline energy carriers the barrel erosion arising as a result of high hydrogen content is thus avoided. Several thousand shots can be fired without any problems, as prescribed by the usual acceptance conditions.

Nitrocellulose is produced by the nitration of cellulose (cotton linters, cellulose) and for more than a hundred years has represented the most important base material for the manufacture of monobasic, dibasic and tribasic propellant charge powders. Nitrocellulose is available in large quantities at favourable prices and is offered with a large range of different chemical and physical properties such as nitrogen content, molecular weight, and viscosity. These differences enable nitrocellulose to be converted into the different homogeneous types of propellant charge powder. The energy content of nitrocellulose is adjusted by means of the nitrogen content. In the monobasic compositions nitrocellulose is the single energy carrier, which means that the energy density of nitrocellulose in comparison to other synthetic binder polymers is relatively high.

In the context of the invention it has now surprisingly been discovered that nitrocellulose can be used as the base material for the manufacture of propulsion systems with IM properties. On the one hand it was unexpectedly established that by the inclusion of just relatively small proportions of a crystalline nitramine compound the chemical stability could be significantly improved in comparison to that of a propulsion system with no nitramine. In this way the ability to resist thermal stimuli is massively improved, as a result of which the desired improvement of the cook-off temperature can be realised.

A further advantage exists in the fact that the base materials are good value and easily available and that no extraordinary ("exotic") steps are required in the manufacture process.

BRIEF DESCRIPTION OF THE DRAWINGS

The drawings used for illustration of the example of embodiment show.

Figure 1:
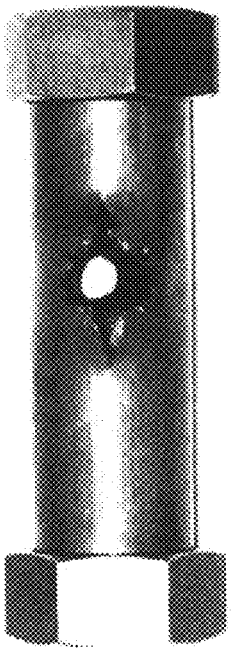
FIG. 1 Ammunition after the agency of a hollow charge jet.

The patent or application file contains at least one drawing executed in color. Copies of this patent or patent application publication with color drawing(s) will be provided by the Office upon request and payment of the necessary fee.

DETAILED DESCRIPTION OF THE INVENTION

The propulsion system is preferably configured in the form of grains, which e.g. have a circular cylindrical geometry with longitudinal passages running in the axial direction (e.g. 1 passage, or 7 or 19 passages). As a result such a propellant charge powder can be agitated (i.e. is free-flowing), a fact which is important for the industrial filling of casings. During the process of filling the casings the propellant charge powder can therefore be handled in a similar manner to a fluid. For large calibre ammunition the material can also take the form of strips, or can be directly extruded into a particular shape that is suitable for barrelled weapons. (However one is not referring to a large volume cast block of the kind used in solid propellant rockets.)

The cylindrical powder grain has a ratio of length (L) to diameter (D) that typically (but not essentially) has a value in the range from L/D=0.25 to L/D=5. The length of the circular cylinder lies e.g. in the range from 0.3 to 10 mm and the diameter in the range from 0.3 to 10 mm.

Instead of cylindrical shapes strip shapes can also be used. These typically include shapes in which the width is much smaller (e.g. by at least 5 times, or at least 10 times) than the length, and the thickness for its part is much smaller (e.g. by at least 5 times, or at least 10 times) than the width. (The thickness lies e.g. at 1 to 2 mm, the width at 10 mm or more, and the length at 100 to 150 mm.)

Also conceivable are so-called "shaped bodies", i.e. hollow cylindrical shapes for an ammunition for which the casing is missing, or in other words is replaced by the "shaped body", located behind the ignition system.

The crystalline nitramine compound preferably contains a structural element of the general chemical structure formula R—N—$NO_2$ (R=residual). Here the proportion of the nitramine structure element in the total molecule should be as high as possible in order to achieve an appropriately high energy content.

Instead of a nitramine compound of the type R—O—$NO_2$, a nitrate ester would e.g. also be conceivable. However the latter is chemically less stable than the nitramine compound.

The crystalline nitramine compound is preferably introduced in a concentration in the range from 1 to 35% by weight. Particularly preferred are concentrations in the range from 5 to 25% by weight. At higher weight proportions for the crystalline energy carriers the crystals are too close to each other in statistical terms, and the vulnerability increases sharply. At weight proportions of up to 20% the vulnerability remains at a very low level.

With an inert plasticising agent in the grain matrix and/or in a surface layer the vulnerability for a given weight proportion of the crystalline nitramine compound can be somewhat reduced. Without any further measures it is thereby possible to work at the upper limit (i.e. at approx 25% by weight of crystalline nitramine).

In the context of the invention it has been shown that RDX has two effects. In the first instance it works as an energy carrier or supplier (property of known art). In the second instance it increases the chemical stability of the propulsion system in the context in accordance with the invention (new property). The stabilisation property comes into effect from approx. just 1% by weight. Thereafter it increases only slightly as the weight proportion increases.

If the nitramine compound is provided as an energy carrier then its weight proportion in the powder grain is usually more than 10%. For stabilisation, materials of known art such as e.g. Akardit II can also be used.

Hexogen (RDX, cyclotrimethylentrinitramine, CAS-#121-82-4), octogen (HMX, tetramethylenetetranitramine, CAS-#2691-41-0, hexanitroisowurtzitane (CL-20, CAS-#14913-74-7), nitroguanidine (NIGU, NQ, CAS-#70-25-7, N-metylnitramine (Tetryl, N-methyl-N,2,4,6-tetranitrobenzolamine, CAS-#479-45-8) and also nitrotriazolone (NTO, CAS#932-64-9) and triaminotrinitrobenzene (TATB, CAS#3058-38-6) are suitable as the crystalline nitramine compound. These compounds can be introduced individually or combined with one another. The crystalline nitraminc compound is e.g. RDX with an average grain size of 6 microns.

RDX is the most interesting of all the crystalline energy carriers cited. It is to be ascertained that the "insensitive" RDX offered in the market (also called I-RDX for RS-RDX) does not provide any improvement in the context in accordance with the invention, although the I-RDX variant is actually offered on the strength of allegedly lower vulnerability.

Octogen is relatively expensive in comparison to RDX. Other nitramine compounds (such as e.g. NIGU etc.) have relatively poor performance in comparison to RDX.

The inert plasticising additive or additives (plasticisers) are fundamentally distributed within the whole grain (i.e. in the grain matrix). Here they are distributed more or less homogeneously in the grain matrix and are more strongly concentrated in the areas near the surface than in the interior of the powder grain. The latter strengthens the desired effect.

The inert plasticising agent homogeneously distributed in the grain matrix preferably has a concentration in the range from 1.0 to 20% by weight. The concentration preferably lies in the range from 1.0 to 10% by weight. In particular 1 to 5% by weight is quite sufficient. The lower the proportion of the inert plasticiser, the higher can be the proportion of energy-rich materials in the grain. The plasticising agents homogeneously distributed in the grain matrix should have a proportion by weight of less than 10%, especially for medium calibre applications.

For small calibre applications the weight proportion of the plasticiser in contrast can certainly rise to 15% by weight (conditional on the ratio of surface to volume in the propellant charge powder).

The inert plasticising agent in the grain matrix can e.g. be an essentially water-insoluble organic polyoxo compound, such as e.g. a polyester or polyether compound with a molecular weight of 50 to 20,000 g/mol. The inert plasticiser enriched in the zone near the surface of the propulsion system is in particular a practically water-insoluble organic compound (typically an organic compound containing carboxyl groups (preferably camphor and/or aromatic resin compounds).

Since the plasticiser is practically water-insoluble the powder can be washed in water in the course of the production process in order to wash out the residual solvent (such as alcohol, diethylether or ethylacetate) that is contained in the powder cake for the extrusion process. The water-insoluble plasticiser remains in the grain during this process. Alternatively the solvent can also be removed by means of air drying. It is then unnecessary for the plasticiser to be water-insoluble.

Citrate esters, adipic acid esters, sebacic acid esters or phthalic acid esters (or hydrated cyclohexyl derivates of these) with a molecular weight from 100 to 20,000 g/mol, or combinations of these, have shown themselves to be particularly suitable.

In the plastics industry (c.f. e.g. Handbook of Plasticizers, ISBN 1-895198-29-1) a very wide variety of plasticisers that are good gelatinators for nitrocellulose are of known art.

As a plasticising additive that is introduced to the zones near the surface of the powder grain, an organic compound containing carboxyl groups, with a molecular weight of 100 to 5000 g/l, is preferred. The weight proportion in the total grain is preferably not more than 10% by weight, in particular less than 6% by weight. Areas of concentration of the inert plasticiser under 15% by weight, localised in the zones near the surface of the propulsion system, can however also be suitable. However, good results are achieved with 1 to 2% by weight for medium calibres. Below 1.0% by weight, however, only an insufficient effect could be established.

The inert plasticising additive that is localised in the zones near the surface of the propulsion system is preferably camphor (CAS-#76-22-2). Similarly aromatic urea derivates such as diethyl diphenyl urea (CAS-#85-98-3), dimethyl diphenyl urea (CAS-#611-92-7), ethyl diphenyl carbamates (CAS-#603-52-1), N-methyl-N-phenylurethanes (CAS-#2621-79-6) or ester compounds such as diethyl phthalate (CAS-#84-66-2), dibutyl phthalate (CAS-#84-74-2), diamyl phthalate (CAS-#131-18-0), di-n-propyladipate (CAS-#106-19-4) come into consideration, or compounds analogous to those that are homogeneously distributed in the grain matrix. The inert plasticising additive can also be applied as a combination of a number of individual compounds.

Examples for the inert plastic additive are acetyl triethyl citrate (CAS-#: 77-89-4), triethyl citrate (CAS-#: 77-93-0), tri-n-butyl citrate (CAS-#:77-94-1), tributyl acetyl citrate (77-90-7), acetyl tri-n-butyl citrate (CAS-: 77-90-7), acetyl tri-n-hexyl citrate (CAS-#: 24817-92-3), n-butyryl tri-n-hexylcitrate (CAS-#: 82469-79-2), di-n-butyl adipate, diisopropyl adipate (CAS-#: 6938-94-9), diisobutyl adipate (CAS-#: 141-04-8), dietlaylhexyl adipate (CAS-#: 103-23-1), nonyl undecyl adipate, n-decyl-n-octyl adipate (CAS-#: 110-29-2), dibutoxy ethoxy ethyl adipate, dimethyl adipate (CAS-#: 627-93-0), hexyl octyl decyl adipate, diisononyl adipate (CAS-#: 33703-08-1), di-n-butyl sebacate (CAS-#: 109-43-3), dioctyl sebacate (CAS-#: 122-62-3), dimethyl sebacate (CAS-#: 106' 79-6), di-n-butyl phthalate (CAS-#: 84-74-2), di-n-hexyl phthalates (CAS-#: 84-75-3), dinonyl undecyl phthalate (CAS-Nr. 111381-91-0), nonyl undecyl phthalate (685-15-43-5), mixtures of predominantly linear C4-C11-alkyl phthalates (CAS4: 85507-79'5, 111381-91-0. 68515-45-7, 68515-44-6, 68515-43-5, 111381-89-6, 111381-90-9, 28553-12-0), dioctyl terephthalate (CAS-#: 6422-86-2), dioctyl isophthalate (CAS-#: 137-89-3), 1,2-cyclohexane dicarbonic acid diisononylester (CAS-#: 166412-78-8), dibutyl maleate (CAS-#: 105-76-0), dinonyl maleate (CAS-#: 2787-64-6), diisooctyl maleate (CAS-#: 1330-76-3), dibutyl fumarate (CAS-#: 105-75-9), dinonyl fumarate (CAS-#: 2787-63-5), dimethyl sebacate (CAS-#: 106-79-6), dibutyl sebacate (CAS-#:109-43-3), diisooctyl sebacate (CAS-#: 27214-90-0), dibutyl azelate (CAS-#: 2917-73-9), diethylene glycol dibenzoate (CAS-#: 120-55-8), trioctyl trimelliate (CAS-#: 89-04-3), trioctyl phosphate (CAS-#: 78-42-2), butyl stearate (CAS-#: 123-95-5), glycerol triacetate (CAS-#: 102'76-1), epoxied soya bean oil (CAS-#: 8013-07-8), epoxied linseed oil (CAS-#: 8016-11-3).

The inert plasticising additives are also sometimes offered under the following trade names. Hexamoll Dinch from the company BASF, Citroflex variants from the company Reilly-Morflex Inc., Greensboro, N.C. USA, including A-2, A-4, A-6, C-2, C-4, C6, B-6, Paraplex variants from the company C. P. Hall Co. Chicago, Ill. USA, including G25, G30, G51, G54, G57, G59, Santicizcr variants from the company Ferro Corporation, Cleveland, Ohio USA, 261, 278, Palatinol variants from the company BASF, Germany.

The plasticising additive that is localised in the zone near the surface of the powder grain has in particular a penetration depth of a few 100 microns. The penetration depth (i.e. the depth in which at least 95% by weight of the additive is to be found), is e.g. a maximum of 400 microns. Thus the maximum effect can be achieved with minimal quantities. That is to say, the grain volume does not contain more inert material than is necessary, which for a prescribed quantity of powder provides the maximum quantity of energetic material. Penetration depths in the range of 100 to 300 microns are preferably to be used.

The propulsion system in accordance with the invention is excellently suitable for small and medium calibre ammunition, i.e. the powder grains have a maximum geometric dimension of 20 mm.

The geometric dimensions of the propellant charge powder in accordance with the invention are primarily determined by the calibre range. Thus the powder grains for small calibre applications (calibre range from approx. 5.56 to approx. 20 mm) on the one hand can exhibit cylindrical geometries with diameters of approx. 0.5 to 3 mm, where the length of a powder grain is typically approx. 0.5 to 2.0×the value of the respective grain diameter. Moreover cylindrical powders can contain longitudinal passages running in the axial direction to influence the combustion characteristics. In practice 1, 7 and 19 hole geometries have proved to be particularly suitable, where the diameter of the hole zones is typically between 0.05 and 0.5 mm.

For medium calibre applications (calibre range from 20 mm to approx 50 mm) the cylindrical grain geometry with a diameter of approx. 1.0 to 10 mm has proved to be suitable from experience, where the length of a powder grain is typically approx 0.5 to 2.0×the value of the respective grain diameter. For control of the combustion characteristics a number of longitudinal passages running in the axial direction are normally included in the powder grain. Powder grains with 1, 7 or 19 longitudinal passages have proved to be particularly suitable, whose diameters are typically 0.05 to 0.5 mm.

For large calibre applications (calibre range from 60 mm to approx 155 mm) the cylindrical grain geometry with a diameter of approx. 3 to 25 mm has proved to be suitable from experience, where the length of a powder grain is typically approx 0.5 to 2×the value of the respective grain diameter. For control of the combustion characteristics a number of lengthwise passages running in the axial direction are normally included in the powder grain. Powder grains with 7, 19 and 51 longitudinal passages have proved to be particularly suitable, whose diameters are typically 0.05 to 0.5 mm. Moreover for large calibre applications the so-called strip powders have also proved to be suitable. Their cross-section is typically rectangular with a thickness of 0.5 to 5 mm, and a width of 3.0 to 20 mm. The length lies typically in the range from 5 to 50 cm.

The propulsion system in accordance with the invention can also be configured as a so-called shaped body. Here the propulsion system additionally takes on the function of the casing and comes into use in so-called caseless ammunition. Conceivable areas of application lie in the calibre ranges from 4.6 to 155 mm, where the geometry of this kind of shaped body is matched to the application in question.

A procedure for the manufacture of a propulsion system in accordance with the invention features the production of a green grain by exerting pressure on a powder cake containing solvent and made of nitrocellulose and a crystalline energy carrier on a nitramine base in an extrusion press, or by means of extrusion.

The propulsion system resulting from the combination in accordance with the invention of a crystalline energy carrier on a nitramine basis with one or a plurality of inert additives in a grain matrix and the areas near the surface, whose binder consists primarily of nitrocellulose, can be manufactured on existing production facilities. The solid composition components can e.g. be impregnated with a solvent mixture. The resulting kneading cake can be kneaded in a kneader and subsequently extruded in a press to the required geometry. The completion into the form of the desired propulsion system can take place by wetting, drying and cutting to the desired grain length. To improve the bonding to the gelled nitrocellulose grain matrix and thus to optimise the desired effects the crystalline nitramine compound can be subjected to a suitable pre-treatment. The bulk densities of the novel propulsion systems are high and can, depending upon the geometric shape, be in excess of 1060 g/l, which is important for achievement of the high internal ballistic performance.

Preferably a powder cake is used that provides a green grain with at least 60% by weight of nitrocellulose, with the nitrogen content of the nitrocellulose lying at between 11 and 13.5% by weight.

It is particularly preferred if the nitrogen content of the nitrocellulose is between 12.6 and 13.25% by weight, if the inert plasticising agent homogeneously distributed in the matrix is a polyester compound (preferably a polyester compound with 2 to 10 ester groups per molecule such as citrates, phthalates, sebacinates and adipates with a molecular weight of 100-5000 g/mol), and if the inert plasticiser enriched in the zones near the surface of the propulsion system is an organic substances containing oxygen atoms and with a molecular weight of 100-5000 g/mol. Most suitable of all is camphor.

For the powder in accordance with the invention further additives of known art can of course also be used. To increase stability, for example, sodium bicarbonate (CAS-#:144-55-8), calcium carbonate (CAS-#: 471-34-1), magnesium oxide (CAS-#: 1309-48-4), Akardit II (CAS-#: 724-18-5), Centralit 1 (CAS-#: 90-93-7), Centralit 11 (CAS-#: 611-92-7), 2-nitrodiphenylamine (CAS-#: 836-30-6) and diphenylamine (CAS-#: 122 39-4) can be used; for barrel protection, for example, magnesium oxide (CAS-#: 1303-48-4), molybdenum trioxide (CAS-30 #: 1313-27-5), magnesium silicate (CAS-#: 14807-96-6), calcium carbonate (CAS-#: 471-34-1) or titanium dioxide (CAS-#: 13463-67-7), tungsten trioxide (CAS-#: 1314-35-8) can be used, and for attenuation of muzzle glow, for example, sodium oxalate (CAS-#: 62-76-0), potassium bitarate (CAS-#: 868-14-4), sodium bicarbonate (CAS-#: 144-55-8), potassium bicarbonate (CAS-#: 298-14-6), sodium oxalate (CAS-#: 62-76-0), potassium sulphate (CAS-#: 7778-80-5) or potassium nitrate (CAS-#: 7757-79-1) can be used. Furthermore the green powder can contain further additives of known art, for example, for improvement of the ignition characteristics and for modulation of the combustion characteristics.

Further advantageous forms of embodiment and combinations of features of the invention ensue from the following detailed description and the totality of the patent claims.

For the following illustrated examples all the additives referred to are added to the powder cake during green grain manufacture, i.e. they are evenly distributed in the matrix. The total quantity of these additives in the green grain lies between 0 and 10% by weight with respect to the nitrocellulose, preferably between 2 and 7% by weight. The manufacture of the propulsion systems includes, amongst others, the process steps "kneading with solvents", "extrusion through moulds", "drying" and "finishing" (surface treatment). The crystalline nitramine compound, which for improvement of the bonding to the matrix may need to undergo pre-treatment, and the inert plasticiser, homogeneously distributed in the matrix, are added to the kneading mass. The inert plasticiser localised in the zone near the surface of the propulsion system is introduced either by impregnation of a "green grain" with an aqueous emulsion, or in a surface treatment process (finishing) together with further additives such as e.g. graphite.

Example 1

5 kg of a 7-hole green powder heated up to 60° C. are manufactured, in a process in which a powder cake made up in the solid proportions of 25% by weight RDX, 1.8% by weight of Akardit-II, 0.4% by weight of calcium sulphate, 0.2% by weight of lime, 0.1% by weight of manganese oxide, 1.5% by weight of a phthalic acid ester (which is constituted predominantly from linear C9-C11 alcohols with an average molecular weight of 450 g/mol and an average dynamic viscosity at 20° C. of 73 mPa*s) and nitrocellulose with a nitrogen content of 13.20% by weight (supplementation to 100%) is worked into a solvent-wetted powder cake and the latter is pressed through a mould (i.e. extruded). The extruded powder grains have an outer diameter of 2.53 mm, a length of 3.08 mm, a wall thickness of 0.53 mm and a hole diameter of 0.12 nun. The green powder manufactured in this manner is placed in a copper polishing drum, preheated to 60° C., with an internal volume of about 50 litres.

Next 7.5 g of powder form graphite (0.15% by weight) is added to the powder mass, followed by a solution of 200 g of camphor in 225 ml of ethanol. Next the reaction is allowed to take effect at a rotational speed of 24 rotations per minute for 2 hours, during which the solvent is gradually evaporated out through the open front opening. The powder is then taken out of the polishing drum and dried for 24 hours at 60° C.

The resulting bulk powder has the following properties:

Physical properties: bulk density=1024 g/l, heat content 3580 J/g.

Chemical stability: deflagration temperature=179° C. heat flow calorimetry (STANAG 4582) 12 J/g or 14.4 μW (requirement in accordance with STANAG 4582: maximum heat development from 5 J/g: <114 μW).

FIG. 1 shows that the vulnerability in the case of bullet impact leads to a Type V reaction (combustion).

Figure 2:
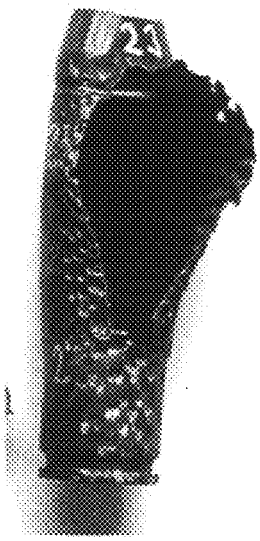
FIG. 2 Ammunition after the agency of hot fragments.
Figure 3:
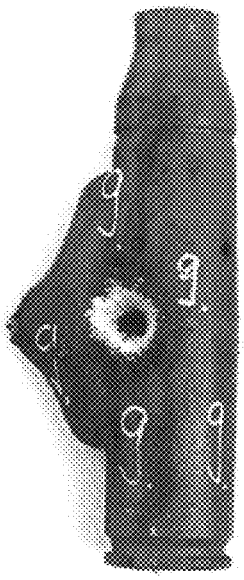
FIG. 3 Ammunition after the agency of a hollow charge jet.

FIG. 2 illustrates the result with bombardment by hot fragments. FIG. 3 shows the result with bombardment with a hollow charge jet. It is to be ascertained that in both cases a Type V reaction (combustion) is present. The ammunition remains in one piece, but the powder is burnt out.

Internal Ballistic Properties:

System: 30 mm full calibre ammunition with a projectile mass of 405 g, casing 30 mm×173, 30 mm Bushmaster II pressure check unit (MANN barrel), optical velocity measurement at 2 m and 5 m after emergence from barrel, pressure measurement Kistler 6215 piezoelectric.

Monobasic comparison powder: length=2.17 mm, diameter 2.29 mm, wall thickness=0.5 mm, hole diameter=0.11 mm, energy content 3403 J/g, bulk density=1039 g/l.

| Firing temperature | −54° C. | −32° C. | +21° C. | +52° C. | +71° C. |
|---|---|---|---|---|---|
| Powder from manufacture example 1 Charge mass = 174 g | | | | | |
| Muzzle velocity [m/s] | 1099 | 1112 | 1124 | 1118 | 1103 |
| Peak gas pressure [bar] | 3641 | 3933 | 4189 | 3951 | 3589 |
| Monobasic comparison powder Charge mass = 174 g | | | | | |
| Muzzle velocity [m/s] | | | 1091 | | |
| Peak gas pressure [bar] | | | 4329 | | |

From the table it can be seen that the propellant charge powder in accordance with the invention has a flat temperature profile. The velocity variation of 12 m/s over the range from −32° C. to +52° C. is small. In comparison to prior art (monobasic comparison powder) the muzzle velocity is higher by 30 m/s. Moreover the peak gas pressure is lower, which allows a higher velocity (approx. +50 m/s) with optimal utilisation of the permitted gas pressure.

Example 2

In analogy with example 1 a 7-hole green powder with 5.49 mm outer diameter, 13.60 mm length, 0.43 mm hole diameter and 1.05 mm wall thickness is manufactured, constituted from the solid proportions of 10% by weight of RDX, 2.0% by weight of Akardit-II, 2.0% by weight of potassium sulphate, 5.0% by weight of a phthalic acid ester (which is constituted primarily from linear C9-C11 alcohols with an average molecular weight of 450 g/mol and with an average dynamic viscosity (20° C.) of 73 mPa*s) and nitrocellulose with a nitrogen content of 12.6% by weight (supplementation to 100%) in the cited manner by pressing a solvent-wetted kneading cake through a mould. The resulting powder has the following properties:

Physical properties: bulk density=855 g/l, heat content=31.90 J/g.

Chemical stability: deflagration temperature=178° C. heat flow calorimetry (STANAG 4582)=7.8 J/g or 8 μW (requirement in accordance with STANAG 4582: maximum heat development from 5 J/g: <114 μW). stability test 132° C. TL: 2.75 ml NaOH.

Vulnerability 1: Test: 35 mm combination test (from Rheinmetall, Unterlüss, Germany), agency of a hollow charge jet: reaction Type V (combustion), agency of hot fragments: reaction Type V (combustion).

Example 3

In analogy with manufacturing example 1 a 7-hole green powder with 2.05 mm outer diameter, 2.30 mm length, 0.13 mm hole diameter and 0.41 mm wall thickness is manufactured, constituted from the solid proportions of 25% by weight of RDX, 1.5% by weight of Akardit-II, 0.4% by weight of potassium sulphate, 2.5% by weight of a phthalic acid ester (which is constituted primarily from linear C9-C11 alcohols with an average molecular weight of 450 g/mol and with an average dynamic viscosity (20° C.) of 73 mPa*s) and nitrocellulose with a nitrogen content of 13.2% by weight (supplementation to 100%) in the cited manner by pressing a solvent-wetted kneading cake through a mould. In analogy with example 1, 5 kg of this green powder is treated in the polishing drum at 60° C. with 10 g graphite (0.2% by weight) and 125 g camphor (2.5% by weight) dissolved in 180 ml of ethanol. The resulting powder has the following properties:

Physical properties: bulk density=1042 g/l, heat content=3808 J/g.

Chemical stability: Deflagration temperature=178° C. Stability test 132° C. TL: 5.52 ml NaOH.

Figure 4:
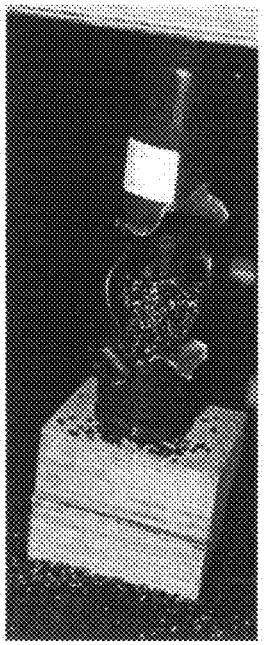
FIG. 4 Ammunition after the impact of a bullet in a 35 mm steel casing.

FIG. 4 shows ammunition after the impact of a bullet in a 35 mm steel casing: a reaction type V (combustion) is present.

Internal ballistic properties: energy content 3824 J/g.

System: 25 mm APFSDS-T dart ammunition with a projectile mass of 129 g (M919), easing 25 mm×137, 25 mm Bushmaster M242 pressure check unit (MANN barrel), optical velocity measurement at 4.2 m and 14.9 m after emergence from barrel, pressure measurement Kistler 6215 piezoelectric. Charge mass=100.0 g For purposes of comparison the propellant charge powder (energy content 3956 l/g) used in production of M919 ammunition was fired at the same time with a charge mass of 101.0 g.

| | 21° C. | 50° C. | 71° C. | −54° C. |
|---|---|---|---|---|
| Powder from example 4, charge 100 g | | | | |
| Muzzle velocity [m/s] | 1430 | 1439 | 1445 | 1403 |
| Peak gas pressure [bar] | 4135 | 4333 | 4409 | 3896 |
| Action time [ms] | 2.88 | 2.78 | 2.79 | 3.19 |
| Thermal efficiency [%] | 34.5 | 35.4 | 35.7 | 33.2 |
| Comparison powder, charge 101 g | | | | |
| Muzzle velocity [m/s] | 1425 | — | 1430 | 1361 |
| Peak gas pressure [bar] | 4150 | — | 4404 | 3436 |
| Action time [ms] | 3.12 | — | 2.87 | 3.62 |
| Thermal efficiency [%] | 32.7 | — | 33.0 | 29.9 |

One can see that the muzzle velocity at 21° C. is higher by 5 m/s than for the reference powder used, in spite of the lower energy content and smaller charge mass. In the cold regime the fall-off of V and Pmax is clearly smaller i.e. the temperature characteristic is advantageous. Moreover the action times and the thermal efficiencies (energy conversion) over the whole temperature range are clearly better, which in practice leads to massive advantages (combustion that is free of residues, better target strike formation).

The action time is shorter, i.e. the combustion process proceeds more quickly. The velocity is 1430 m/s instead of only 1425 m/s. To be emphasised in particular is the better energy utilisation, e.g. 34.5% compared with 32.7%.

The test shows that in spite of a 130 J/g lower energy content, compared with the comparison example in accordance with prior art, an outstanding performance is obtained at a lower gas pressure.

Example 4

In analogy with example 1 a 7-hole green powder with 2.32 mm outer diameter, 2.62 mm length, 0.14 mm hole diameter and 0.47 mm wall thickness is manufactured, constituted from the solid proportions of 25% by weight of RDX, 1.5% by weight of Akardit-II, 0.4% by weight of potassium sulphate, 2.0% by weight of a phthalic acid ester (which is constituted primarily from linear C9-C11 alcohols with an average molecular weight of 450 g/mol and with an average dynamic viscosity (20° C.) of 73 mPa*s) and nitrocellulose with a nitrogen content of 13.2% by weight (supplementation to 100%) in the cited manner by pressing a solvent-wetted kneading cake through a mould. In analogy with example 1, 5 kg of this green powder is treated in the polishing drum at 60° C. with 12.5 g graphite (0.25% by weight) and 100 g camphor (2.0% by weight) dissolved in 170 ml of ethanol. The resulting powder has the following properties:

Physical properties: bulk density=1051 g/l, heat content=3900 J/g.

Internal ballistic properties in 25 mm full calibre ammunition with a projectile mass of 205 g, casing 25 mm×137, 25 mm Bushmaster M242 pressure check unit (MANN barrel), optical velocity measurement at 12.5 m and 17.2 m after emergence from barrel, pressure measurement Kistler 6215 piezoelectric. The charge mass was 92.0 g, corresponding to a filling density of 0.939.

+21° C.: vo=1151 m/s at 4095 bar. Action time t4=3.55 ms.
+50° C.: vo=1154 m/s at 4136 bar. Action time t4=3.50 ms.
+71° C.: vo=1158 m/s at 4275 bar. Action time t4=3.43 ms.
−54° C.: vo=1150 m/s at 4084 bar. Action time t4=3.56 ms.

The muzzle velocity at +21° C. is about 70 m/s higher than with a normal monobasic TLP. Moreover the temperature characteristic is extremely flat over the very wide temperature range from −54° C. to +71° C. The t4 action times are very short over the whole temperature range and serve as evidence for the surprisingly rapid thermal conversion of the new powder type. At +21° C. the thermal efficiency is 40%, i.e. the internal energy of the new type of powder is converted very well.

Example 5

In analogy with example 1 a 7-hole green powder with 5.56 mm outer diameter, 13.59 mm length, 0.48 mm hole diameter and 1.03 mm wall thickness is manufactured constituted from the solid proportions of 15% by weight of RDX, 2.0% by weight of Akardit-II, 2.0% by weight of potassium sulphate, 2.5% by weight of a phthalic acid ester (which is constituted primarily from linear C9-C11 alcohols with an average molecular weight of 450 g/mol and with an average dynamic viscosity (20° C.) of 73 mPa*s) and nitrocellulose with a nitrogen content of 12.6% by weight (supplementation to 100%) in the cited manner by pressing a solvent-wetted kneading cake through a mould. In analogy with example 1, 5 kg of this green powder is treated in the polishing drum at 60° C. with 1.0 g graphite (0.2% by weight) and 150 g camphor (3.0% by weight) dissolved in 200 ml of ethanol. The resulting powder has the following properties:

Physical properties: bulk density=916 g/l, heat content=3255 J/g.

Chemical stability: deflagration temperature=179° C. heat flow calorimetry (STANAG 4582)=12.1 J/g or 14 μW (requirement in accordance with STANAG 4582: maximum heat development from 5 J/g: <114 μW).

Vulnerability 1: Test: 35 mm combination test (from Rheinmetall, Unterlüss, Germany), agency of a hollow charge jet: reaction Type A (V, combustion), agency of hot fragments: reaction Type A (V, combustion).

Vulnerability 2: Test: Bullet impact test in UN steel tube: reaction Type V (combustion)

In summary it is to be ascertained that the propellant charge powders containing nitrocellulose in accordance with the invention, which contain a crystalline energy carrier on a nitramine base and an inert plasticising additive, can be used in the calibre ranges from 5.56 mm (small calibre) up to about 155 mm (medium to large calibre, mortars) over a wide range for the acceleration of the projectile in question. The novel propulsion systems have a high ballistic performance and can thus be used in high performance applications such as KE ammunition (dart ammunition) or also in full calibre applications (airburst, ammunition in tanks, artillery and aircraft) without restrictions.

The use of nitrocellulose as a main constituent of the grain matrix (=bir.der) offers advantages, because the raw materials are freely available, renewable and cost-effective, because the manufacture of the propellant charge powder can be undertaken using established processes in existing production facilities, and also provide better reproducibility (a high level of uniformity) of the product properties.

The patent or application file contains at least one drawing executed in color. Copies of this patent or patent application publication with color drawing(s) will be provided by the office upon request and payment of the necessary fee.

The use of relatively high quantities of nitrocellulose in the matrix has a positive effect on the mechanical properties, in particular in the cold regime at temperatures of <0. The mechanical properties of plastic bonded LOVA-TLP with high filling densities of crystalline energy carriers are not so good, i.e. these types of TLP are relatively unstable or become unstable with increasing age. In the event of mechanical agencies such as those occurring during the firing sequence or as a result of enemy bombardment of the ammunition, these types of powder grains can degrade, leading to dangerous pressure rises or to detonative reactions. The new IM-TLPs to be protected exhibit advantages here with regard to unstable behaviour at cold temperatures. Dangerous pressure rises during firing of the ammunition and detonative reactions of the ammunition in the event of enemy bombardment of the ammunition by hot fragments, bullets or hollow charge jets are thus effectively eliminated.

The new IM propulsion systems exhibit a better chemical stability in comparison to conventional monobasic TLPs, and dibasic and tribasic TLPs containing nitroglycerine, which is reflected in improvements with regard to cook-off resistance (storability at high temperatures). This is of great advantage for aircraft ammunition applications with high thermal loading peaks, or for use of the ammunition in hot climate zones.

The new IM propulsion systems are distinguished by the fact that their chemical energy content (heat content) can be converted at high conversion rates into muzzle kinetic energy of the propelled projectile. In small calibre types of ammunition the efficiencies are up to 36% whilst maintaining the weapon system requirements, and in fact at a high velocity level, such as has only previously been achieved by TLPs that are of known art e.g. from EP 1,164,116 B1 ("EI®-TLPs"), (i.e. approx 50 m/s more than for conventional monobasic TLPs.) In full calibre applications efficiencies of up to 44% are achieved whilst maintaining the weapon system requirements (for comparison: 39% with EI®-TLPs).

The new IM propulsion systems in accordance with the invention are distinguished in general by a very neutral temperature characteristic, which is achieved by means of the layered type of structure, and can be used in a controllable manner. This means that the values of peak gas pressure and muzzle velocity at hot and cold temperatures deviate only relatively slightly in comparison to the values fired at 21° C. This has the effect that the ammunition can be fired independently of the ambient temperature over the whole temperature range with practically the same internal ballistic performance data. This behaviour, already of known art from EI®-TLPs, brings with it advantages with regard to first hit probability, utilisation of the system-conditioned performance reserves and design simplicity.

The invention claimed is:

1. A propulsion system for the acceleration of projectiles that is based on nitrocellulose, characterised in that it contains a crystalline energy carrier on a nitramine base and one or a plurality of inert plasticising additives, wherein at least one of the inert plasticising additives is homogeneously distributed in a matrix of the propulsion system, and another inert plasticising additive has an increased concentration in zones near the surface to a maximum penetration depth of 400 microns.

2. The propulsion system according to claim 1, characterised in that it consists of grains that have a circular cylindrical geometry and lengthwise passages running in the axial direction.

3. The propulsion system according to claim 1, characterised in that the crystalline energy carrier on the nitramine base contains a nitramine compound of the general chemical structural formula R—N—$NO_2$, where R is a residual.

4. The propulsion system according to claim 3, characterised in that the nitramine compound is present in a concentration in the range from 1 to 35% by weight.

5. The propulsion system according to claim 3, characterised in that the nitramine compound is RDX.

6. The propulsion system according to claim 1, characterised in that the inert plasticising additive homogeneously distributed in the matrix of the propulsion system has a concentration in the range from 0.5 to 20% by weight.

7. The propulsion system according to claim 1, characterised in that the inert plasticising additive homogeneously distributed in the matrix of the propulsion system is an essentially water-insoluble organic polyoxo compound, in particular a polyester or a polyether compound with a molecular weight of 50 to 20,000 g/mol.

8. The propulsion system according to claim 7, characterised in that the inert plasticising additive homogeneously distributed in the matrix of the propulsion system contains a water-insoluble citrate ester, an adipic acid ester, a sebacic acid ester or a phtalic acid ester and/or hydrated cyclohexyl derivates of these with a molecular weight of 100 to 20,000 g/mol.

9. The propulsion system according to claim 1, characterised in that the inert plasticising additive with an increased concentration in the zones near the surface has a weight proportion in the total grain of not more than 10% by weight.

10. The propulsion system according to claim 1, characterised in that the inert plasticising additives are organic compounds containing carboxyl groups, with a molecular weight of 100-5000 g/mol.

11. The propulsion system according to claim 10, characterised in that the inert plasticising additive with an increased concentration in the zones near the surface is essentially camphor.

12. The propulsion system according to claim 1, characterised in that it consists of grains with a maximum geometric dimension of 20 mm.

13. A propulsion system according to claim 1, characterized in that the inert plasticising additive homogeneously distributed in the matrix of the propulsion system is a phthalic acid ester formed from 1,2-benzenedicarboxylic acid and two alcohols with 1-11 carbon atoms.

14. A propulsion system according to claim 1, characterised in that it contains RDX and that the inert plasticizing additive homogeneously distributed in the matrix of the propulsion system is a phthalic acid ester formed from 1,2-benzenedicarboxylic acid and two alcohols with 1-11 carbon atoms.

15. The propulsion system according to claim 2, characterized in that the crystalline energy carrier on the nitramine base contains a nitramine compound of the general chemical structural formula R—N—$NO_2$, where R is a residual.

16. The propulsion system according to claim 4, characterised in that the nitramine compound is RDX.

* * * * *